United States Patent [19]

Breton et al.

[11] Patent Number: 4,725,522

[45] Date of Patent: Feb. 16, 1988

[54] PROCESSES FOR COLD PRESSURE FIXABLE ENCAPSULATED TONER COMPOSITIONS

[75] Inventors: Marcel P. Breton, Toronto; Kar P. Lok, Sarnia, both of Canada

[73] Assignee: Xerox Corporation, Stamford, Conn.

[21] Appl. No.: 919,517

[22] Filed: Oct. 16, 1986

[51] Int. Cl.[4] ..... G03G 11/00

[52] U.S. Cl. ..... 430/138; 427/222

[58] Field of Search ..... 430/137, 138, 110; 427/218, 222

[56] References Cited

U.S. PATENT DOCUMENTS 4,500,494 2/1985 Scher ..... 424/32

4,576,890 3/1986 Hosoi ..... 430/137

*Primary Examiner*—John L. Goodrow

*Attorney, Agent, or Firm*—E. O. Palazzo

[57] ABSTRACT

A process for the preparation of cold pressure fixable toner compositions which comprises (1) admixing a core component comprised of pigment particles, a water insoluble organic solvent and elastomeric materials with a shell monomer dissolved therein; (2) dispersing the resulting mixture in a water phase containing a stabilizing material; (3) hydrolyzing by heating the resulting mixture; (4) subsequently affecting an interfacial polymerization of the aforementioned mixture; and (5) thereafter optionally washing the resulting toner composition.

30 Claims, No Drawings

PROCESSES FOR COLD PRESSURE FIXABLE ENCAPSULATED TONER COMPOSITIONS

BACKGROUND OF THE INVENTION

The present invention is generally directed to processes for the preparation of cold pressure fixable toner compositions, and more specifically the present invention is directed to processes for obtaining single and/or two component cold pressure fixable toner compositions comprised of a core of carbon black, and a tough polymeric shell generated by an interfacial polymerization process, wherein the shell monomer is dissolved in the core prior to polymerization. Accordingly, in an embodiment of the present invention there are provided processes for formulating in an economical, and simple manner cold pressure fixable toner compositions by dispersing or dissolving the shell components in the core material selected for the toner, followed by hydrolysis, and subsequently an interfacial polymerization. The toners resulting are useful for permitting the development of images in electrostatographic imaging systems, inclusive of electrostatic imaging processes wherein pressure fixing, especially pressure fixing in the absence of heat is selected.

Cold pressure fixing processes are known. These processes have a number of advantages in comparison to heat fixing, primarily relating to the requirements for less energy since the toner compositions used can be fused at room temperature. Nevertheless, many of the prior art cold pressure fixable toner compositions suffer from a number of deficiencies. For example, these toner compositions must usually be fused under high pressure, which has a tendency to severely disrupt the toner fusing characteristics of the toner selected. This can result in images of low resolution, or no images whatsoever. Also, in some of the prior art processes substantial image smearing can result from the high pressures required. Additionally, the cold pressure fixing toner compositions of the prior art have other disadvantages in that, for example, these compositions when used for development cause in some instances images with high gloss that are of low crease resistance. Furthermore, the images resulting exhibit an undesirable carbon paper effect, thus there is a total or partial image transfer from the image substrate to neighboring substrates caused by pressures arising from normal handling. In contrast, images developed with the cold pressure compositions prepared in accordance with the process of the present invention posses a low gloss appearance on plain paper, and further there is no carbon paper effect observed. Also, the toner compositions prepared in accordance with the process of the present invention have hard shells thus enabling images of excellent resolution with substantially no background deposits. Accordingly, with the process of the present invention inner polymerization methods permit the formation of aromatic polyurea shells, that is polymers wherein the main chains are comprised of aromatic groups. These polymers possess different characteristics, for example they are tougher and stronger than several prior art shells prepared by the interfacial polymerization of, for example, an aromatic or aliphatic oil soluble component with a water soluble aliphatic amine or alcohol. Furthermore, when shells are prepared from water soluble aromatics, such as phenol derivatives, it is often necessary to use solutions of a high pH value. This adversely affects the interfacial polymerization and the efficiency of added surfactants such as poly(vinylalcohol). When the efficiency of the surfactants is decreased, it is difficult to prepare toner particles with the appropriate diameter for use in imaging processes, and in addition agglomeration of the particles results.

With further reference to the prior art, there is disclosed in U.S. Pat. No. 4,307,169 microcapsular electrostatic marking particles containing a pressure fixable core, and an encapsulating substance comprised of a pressure rupturable shell, which shell is formed by an interfacial polymerization. One shell prepared in accordance with the teachings of this patent is a polyamide obtained by interfacial polymerization. In the U.S. Pat. No. 4,307,169, it is indicated that when magnetite or carbon black is selected they must be treated in a separate process to prevent migration thereof to the oil phase.

Interfacial polymerization processes are described in British Patent Publication No. 1,371,179, the disclosure of which is totally incorporated herein by reference, which publication illustrates a method of microencapsulation based on in situ interfacial condensation polymerization. More specifically, this publication discloses a process which permits the encapsulation of organic pesticides by the hydrolysis of polymethylene polyphenylisocyanate, or toluene diisocyanate monomers. There is no teaching, however, in the '179 publication relating to a process for preparing cold pressure fixable two component toners. Also, the wall forming reaction disclosed in the aforementioned publication is initiated by heating the mixture to an elevated temperature at which point the isocyante monomers are hydrolized at the interface to form amines, which in turn react with unhydrolized isocyanate monomers to enable the formulation of a polyurea microcapsule wall. One difficulty associated with the process of the '179 publication resides in the possibility of the continued reaction of monomer after packaging. Therefore, unless the monomer selected is reacted during the preparation, there will be continued hydrolysis with evolution of carbon dioxide resulting in the formation of pressure. This problem, which is overcome with the process of the present invention, is also illustrated in European Patent Application No. 84870186.8. Furthermore, with the process of the present invention the appropriate solvent selection (the amount of, for example, isocyanate shell materials used), the improved control of the hydrolysis reactions being accomplished as determined by an analysis of the kinetics thereof, and the design of a suitable reaction temperature profile enable the formation of toners with acceptable levels of residual isocyanates, that is no monomers are detectable by thermogravimetric analysis at the highest sensitivity setting. The process of the present invention also permits the controlled formation of oligomers which impart improved fusing characteristics to the resulting toner compositions. Additionally, with the process of the present invention the disadvantages of the post-treatment of the toner compositions prepared under controlled conditions are prevented thereby avoiding continued evolution of carbon dioxide, and excessive aggregations.

Furthermore, there is disclosed in U.S. Pat. No. 4,552,811, a process for capsule formation by an an inner polymerization process. In this process, the reactants forming the interfacial materials are dispersed in the water phase, and not in an organic phase.

Moreover, there is disclosed in U.S. Pat. No. 4,407,922, the disclosure of which is totally incorporated herein by reference, interfacial polymerization processes for pressure sensitive toner compositions comprised of a blend of two immiscible polymers selected from the group consisting of certain polymers as a hard component, and polyoctyldecylvinylether-comaleic anhydride as a soft component.

Additionally, illustrated in a copending application U.S. Ser. No. 621,307, entitled Single Component Cold Pressure Fixable Encapsulated Toner Composition, the disclosure of which is totally incorporated herein by reference, are single component cold pressure fixable toner compositions, wherein the shell selected can be prepared by an interfacial polymerization process. A similar teaching is present in copending application U.S. Ser. No. 718,676, the disclosure of which is totally incorporated herein by reference, directed to single component magnetic cold pressure fixable toner compositions. In the aforementioned application, the core can be comprised of magnetite and a polyisobutylene of a specific molecular weight encapsulated in a polymeric shell material generated by an interfacial polymerization process. More specifically, there is illustrated in the aforementioned copending application cold pressure fixable magnetic single component developers with small amounts of carbon black and large amounts of magnetite.

Furthermore, other prior art that might be of background interest includes U.S. Pat. Nos. 4,254,201; 4,465,755; 4,520,091; and Japanese Patent Publication No. 58-100857. The Japanese publication discloses a capsule toner with high mechanical strength, which is comprised of a core material including a display recording material, a binder, and an outer shell enclosing the core material, which outer shell is preferably comprised of a polyurea resin. In the U.S. Pat. No. 4,520,091, there is disclosed encapsulated electrostatographic toners wherein the shell material comprises at least one resin selected from polyurethane resins, a polyurea resin, or a polyamide resin. In addition, the U.S. Pat. No. 4,465,755 discloses a pressure fixable toner comprising encapsulated particles containing a curing agent, and wherein the shell is comprised of a polyurethane, a polyurea, or a polythiourethane. Moreover, in the U.S. Pat. No. 4,254,201 there is illustrated pressure sensitive adhesive toners comprised of clustered encapsulated porous particles, which toners are prepared by spray drying an aqueous dispersion of the granules containing an encapsulated material.

Accordingly, there is a need for improved processes that will enable cold pressure fixable toner compositions with hard shells. Also, there is a need for improved processes that will permit the formulation of cold pressure fixable toner compositions with carbon black, or magnetite as the core material. There is also a need for improved processes that will enable cold pressure fixable toner compositions with mixtures of carbon black and magnetite as the core material. Additionally, there is a need for simple economical interfacial polymerization processes that will allow hard shells to be generated for cold pressure fixable toner compositions. There is also a need for improved processes that will provide cold pressure fixable toner compositions with hard shells, and wherein the monomer selected for the shell is dissolved in the core. Moreover, there is a need for a process that permits the selected control of the toner electrical properties, inclusive of dielectric constant characteristics, and triboelectrics charging properties. The aforementioned properties, and characteristics properties are dependent primarily on the type of carbon black dispersion, and the carbon black loading.

Another advantage associated with the process of the present invention resides in the ability to control the shell properties thereby permitting, for example, desirable toner properties inclusive of appropriate toner particle size, and acceptable fixing and smear properties. Indirectly, there is also permitted in accordance with the process of the present invention the monitoring of small changes in core properties, such as the viscosity thereof, and the pigment dispersion characteristics. The aforementioned advantages are demonstrated hereinafter, and in particular in Example X.

SUMMARY OF THE INVENTION

It is an object of the present invention to provide processes for cold pressure fixable toner compositions which overcome many of the above-noted disadvantages.

In another object of the present invention there are provided processes for cold pressure fixable toner compositions with hard shells formulated by an improved interfacial polymerization process.

Also, in a further object of the present invention there are provided processes for cold pressure fixable toner compositions with hard shells, wherein the shell monomer is dissolved in the core component selected.

Further, an additional object of the present invention resides in simple and economical processes for the preparation of cold pressure fixable toner compositions with hard shells formulated by an improved hydrolysis, and interfacial polymerization process.

An additional object of the present invention resides in the provision of a cold pressure fixable toner with optimized smear and fix properties, obtained as a result of, for example, the controlled additions of small amounts, preferably between 1 and about 10 percent by weight of reinforcing agents, such as a polymeric material, thus causing a modification of the rheological properties of the toner core composition prepared from elastomer components.

Additionally, in another object of the present invention there are provided carbon black or magnetite based cold pressure fixable toner composition.

In yet still another object of the present invention there are provided encapsulated toners with a substantially uniform thickness for the protecting shell.

In another object of the present invention there are provided carbon black based cold pressure fixable toner with improved blocking and fusing characteristics.

These and other objects of the present invention are accomplished by the provision of processes for the formulation of cold pressure fixable toner compositions with an improved interfacial polymerization. More specifically, there is provided in accordance with the present invention a process for the preparation of cold pressure fixable toner compositions wherein a hard shell component is obtained by hydrolysis and interfacial polymerization. In another embodiment of the present invention the process comprises the formulation of a tough aromatic polyurea shell, that is a shell that will withstand most toner manufacturing process, especially spray drying a processes; and also wherein there can be formulated a substantially unbreakable or uncrackable shell. With the process of the present invention, in one important aspect thereof the shell monomer is dissolved in the toner core of carbon black, or mixtures of carbon black and magnetite.

In addition, there is provided in accordance with the present invention a process for the preparation of cold pressure fixable toner compositions which comprises (1) admixing a core component comprised of pigment particles, a water insoluble organic solvent and elastomeric materials and a shell monomer dissolved therein; (2) dispersing the resulting mixture in a water phase containing a stabilizing material; (3) hydrolyzing by heating the resulting mixture; (4) subsequently affecting an interfacial polymerization of the aforementioned mixture; and (5) thereafter optionally washing the resulting toner composition.

More specifically, the process of the present invention involves the preparation of cold pressure fixable toner compositions which comprises (1) admixing a core component comprised of pigment particles in an amount of from about 5 to about 30 percent by weight of the final toner, a wate insoluble organic solvent and, for example, polyisobutylene elastomeric materials in an amount of from about 30 to about 50 percent by weight of the final toner with a shell monomer dissolved therein in an amount of from about 10 to about 45 percent by weight of the final toner; (2) dispersing the resulting mixture in a water phase containing a stabilizing material; (3) hydrolyzing the resulting mixture by heating, for example, at a temperature of from about 35 to about 70 degrees Centigrade; (4) subsequently affecting interfacial polymerization thereof by heating the mixture resulting from, for example, about 70 to 90 degrees Centigrade; and (5) thereafter washing the toner product obtained. The aforementioned washing is accomplished primarily for the purpose of causing the removal of stabilizing materials, and further the toner product obtained can be subsequently dried preferably utilizing spray drying processes.

In one specific embodiment of the present invention, the process comprises (1) dispersing carbon black in an amount of from about 5 percent to about 30 percent by weight in an organic solution comprised of a mixture of cyclohexane and dichloromethane, adding an elastomer of polyisobutylene thereto in an amount of from about 30 to about 50 percent by weight of the final toner, and subsequently dispersing therein magnetite in an amount of from 1 to about 20 percent by weight; (2) thereafter adding shell monomers, such as toluene diisocyanate in an amount of from about 10 to about 45 percent by weight, and tris(p-isocyanato-phenyl)thiophosphate, in an amount of from about 0.5% percent to about 10 percent by weight; (3) dispersing the resulting mixture in water in an amount of from about 5 to about 45 percent by volume containing from about 0.2 to about 2 percent by weight of poly(vinyl alcohol) or a similar surfactant stabilizer, preferably by using a shear homogenizer; (4) subsequently heating the reaction mixture at a sufficient temperature to permit hydrolysis, preferably from about 35 to about 70 degrees Centigrade; and thereafter heating at a higher temperature, preferably from about 70 to about 90 degrees Centigrade, enabling further hydrolysis and interfacial polymerization, thereby allowing the formation of a hard polyurea shell; (5) subsequently washing the resulting toner with distilled water for a sufficient period of time that will enable substantially no residual poly(vinyl alcohol) to remain in the water; and (6) thereafter spray drying the washed toner composition product thereby yielding a free flowing toner powder. Additionally, in accordance with the process of the present invention there can be added to the toner composition obtained optional additive particles, such as from about 0.2 to 2 percent by weight, and preferably from about 0.2 to about 1.0 percent by weight of a flow agent. Examples of flow agents that may be selected are Aerosils, reference U.S. Pat. No. 3,900,588, the disclosure of which is totally incorporated herein by reference, such as Aerosil R972, Aerosil R974, and the like, available from Degussa Canada Ltd.. Also, the size diameter of the resulting particles can be controlled effectively from about 5 microns to 50 microns, and preferably from 10 microns to 30 microns, which size depends, for example, on such parameters as the nature and concentration of the surfactant used, the homogenizer type and speed, the nature and amount of reinforcing agent, the initial core viscosity prior to the dispersion of the organic phase into the water phase, the ratio of organic to water phase, the temperature, and the nature of the solvent used to solubilize the core polymer. Therefore, the resulting toner can contain in the core carbon black and/or magnetite dispersed in a polymeric matrix of polyisobutylene, and an optional polymeric reinforcing agent in an amount of from about 1 to about 10 percent, such as a block copolymer of styrene butadiene, available as Kraton, the primary function of which is to increase the elastomer compression modulus. Other examples of reinforcing agents include styrene-butadiene (Kraton) diblock copolymers. The toner may also contain as compression modulus modifiers in various effective amounts, such as for example from about 5 to about 50 percent by weight, styrene-isoprene diblock copolymers, styrene-isoprene-styrene triblock polymers, alpha-methylstyrene-butadiene diblock copolymers, alpha-methylstyrene-butadiene-alpha-methylstyrene triblock copolymers, and the like.

Illustrative examples of elastomers that may be selected for the process of the present invention are polyisobutylene, polybutadiene, polybutenes, polyisoprenes, polysiloxanes, copolymers of the aforementioned compositions, inclusive of poly(styrene-butadiene); and other similar equivalent polymers such as those with the same, or a similar compression modulus.

Illustrative examples of carbon black core components include carbon blacks available from Cabot, Degussa, Capuava and Columbian carbon blacks such as Regal ® 330, Vulcan XC-72R, Raven 5750, 5250 and 5250B, 3500 and 3200, Printex type carbon blacks, and N-326 type from Capuava. It is preferable to use high surface area carbon blacks in the process described therein. The carbon black can be present in an amount of from about 5 percent by weight to about 30 percent by weight Magnetites that can be selected are commercially available as MO-7029, MO-8029, and MO-4431 from Pfizer Corporation; Mapico Black from Columbia Inc.; Bayferrox magnetites from Mobay Chemical, and the like. The magnetites, which are admixed with the carbon black, are present in an amount of from about 1 percent by weight to about 20 percent by weight.

Examples of shell materials include toluene diisocyanates, isophthaloyl chloride, m-phenylenediisocyanate, naphthalene-1,4, diisocyanate or other aromatic isocyanate substituted of the same family. Included in this family are tri-, tetra-, and polyisocyanate prepolymers capable of providing hard shells by an in-situ interfacial polymerization process as described herein.

Surfactants or emulsion stabilizers, in an amount of from about 0.2 to about 2 percent that may be selected for the process of the present invention are poly(vinyl alcohol), hydroxypropyl cellulose, poly(ethylene oxide-co-propylene oxide), hydroxyethylcelluloses, and the like.

Illustrative examples of solvents selected for the process of the present invention include known organic solvents such as hydrocarbons inclusive of cyclohexane, dichloromethane, 1,1,1 trichloroethane, and other similar solvents of a boiling point below about 80° C.

Final properties of the toner prepared by the process of the present invention are also dependent on the following process parameters: (1) the temperature at which the hydrolysis occurs as well as the temperature profile thereof, which temperature can vary from about 20° C. to about 90° C., and preferably is between 55° C. and 70° C. Different temperature profiles are applicable to the process, preferably the first stage of the process must include a period of time during which the temperature is increased very slowly in order to control foaming due to the gas evolution during the hydrolysis; and (2) the mixing times are critical in determining in the first stage the extent of carbon black dispersion in the organic phase and secondly, the final particle size. X-ray can be used to obtain inner surface area (Os) data on carbon black containing toners. In that context, Os values can give indications of the quality of the dispersions. Values ranging from 13 to 28 meters square per centimeter cube were obtained for encapsulated toners containing 20 to 24 percent carbon black. Larger inner surface area values are indication of better carbon black dispersion all other factors being the same. When toners are prepared by more standard methods such as melt blending these values are obtained with much less than 10 percent loading. It is known that within the above range of Os values, the above discussed electrical properties of the present invention can vary by about 20 percent. It is believed that encapsulation technology allows control of these variations at higher loading of carbon black.

The following examples are being submitted to further define various species of the present invention. These examples are intended to be illustrative only and are not intended to limit the scope of the present invention. Also, in the Examples parts and percentages are by weight unless otherwise indicated.

EXAMPLE I

There was prepared a carbon black encapsulated toner as follows: Raven 5250 carbon black, 12 grams, polyisobutylene, Vistanex LMMH (Exxon), 22.0 grams, cyclohexane ACS (Caledon), 120.0 grams, and 5 millimeters (diameter) ball bearings (⅓ of total volume) were placed in a 250 milliliters plastic bottle and ball milled for 24 hours. Toluene diisocyanate (Olin Chemicals, type TD1-80), 10 grams, and Desmodur RF, a triisocyanate crosslinking agent from Bayer, 25 milliliters in dichloromethane, 20 milliliters, were added to 97.5 grams of the previously prepared mixture (without any ball bearings). The mixture was then homogenized by shaking in a capped plastic bottle for 20 seconds. Thereafter, the contents of the plastic bottle were added to a mixture of 0.75 percent poly(vinyl alcohol) (Scientific Polymer Products), 500 milliliters, and 2-decanol, 0.5 milliliters, followed by dispersion with a Brinkmann PT 45/80 homogenizer and a PT 35/4 generator for 15 seconds at 6500 rpm. Subsequently, the resulting mixture was transferred to a 2 liter beaker equipped with a mechanical stirrer, and an oil bath under the beaker. The mixture was then heated at 50° C. for three hours during which time a polymerization reaction took place to form a polyurea shell. Thereafter, the temperature was increased to 68° C. for 16 hours permitting reaction completion and removal of cyclohexane and dichloromethane. The reaction mixture was then allowed to stabilize at room temperature, and the toner composition resulting was washed with water, and settled using an IEC-B20A centrifuge for 12 minutes at 8,000 rpm. This procedure was repeated three times. The washed toner was then filtered through a 212 micron screen filter to remove any aggregates, followed by spray drying in a Büchi model 190 spray dryer at an inlet temperature of 120° C. and outlet temperature of 94° C. The average particle size of the resulting toner particle product was 13.5 microns with a GSD of 1.40 as determined with a Coulter counter. After the addition of 1 percent by weight of Aerosil R972, available from Degussa Canada Ltd., this toner could be imaged on a flat plate test fixture with an Ektaprint L organic photoreceptor belt (green type), available from Eastman Kodak. After fusing with a Hitachi three-roll fuser set at 2000 psi, the images exhibited strong crease and smear resistance. Furthermore, subsequent to the rubbing of the images obtained with fingers, it was found that there was essentially no smearing of the images, that is there was no deterioration of the image resolution and no toner was removed from the paper onto the finger.

Crease was determined qualitatively by folding the image under reproducible conditions and examining the crease area visually with an optical microscope. The width of the crease and the residual toner amount in the crease area can give a relative estimate of the crease quality. The aforementioned cold pressure fixable toner had better creae properties than a standard heat fusible toner comprised of a styrene n-butylmethacrylate resin, 90 percent by weight, and carbon black particles, 10 percent by weight, in that the amount of residual toner present in the crease area was always larger, about 50 percent more for the above prepared cold pressure fixable toner as compared to the aforementioned standard toner.

EXAMPLE II

A carbon black encapsulated toner was prepared by admixing a dispersion of the carbon black pigment, Raven 5250 (8 parts), toluene diisocyanate (10 parts) and tris(p-isocyanate-phenyl)thiophosphate (1 part a triisocyanate crosslinker sold under the trade name Desmodur RF) in a solution of polyisobutylene (Vistanex LMMH) (12 parts) in a mixture of cyclohexane (20 parts) and dichloromethane (30 parts). The organic component thus prepared was dispersed into water (300 parts) containing 0.75 percent poly(vinyl alcohol) by a high shear homogenizer polytron. The reaction mixture was then transferred to a reactor equipped with a mechanical stirrer. Shell formation was affected by raising the temperature to 55° C. for 3 hours and subsequently to 75° C. for another 5 hours. The capsules are washed with water and spray dried under conditions similar to those described in Example I. The reactive ingredients, the di- and tri-isocyanates are in the core phase. The shell material is formed when the reaction temperature is raised to promote the hydrolysis of the isocyanate functions to amine groups at the interface which in turn react with the remaining isocyanate groups to yield an all aromatic polyurea shell. The resulting dried toner has acceptable blocking temperature greater than 50° C. Tribo blow-off measurements reveal that the toner charges to a +30 microcoulombs per gram against a carrier core consisting of iron oxide, and a terpolymer mixture of styrene, methylmethacrylate and vinyl triethoxy silane. Powder cloud images of this toner, that is images prepared by overlaying controlled amounts of toners on a piece of paper (stencils were used in order to obtain different image patterns), were fixed using a Hitachi three-roll fuser set at about 2,000 psi (125 pli) yield images with excellent fix, that is the ratio of optical density before and after a Taber abrasion test of 0.54 was measured based on a standard optical density of 1.0. In addition, the image exhibits strong crease and smear resistance when tested under the condition described in Example I.

EXAMPLE III

A carbon black encapsulated toner was prepared as follows: Vistanex LMMH, 20.7 grams, Kraton DX-1115, 1.32 grams, a styrenebutadiene triblock polymer (Shell) were dissolved in cyclohexane 120 grams. To help speed up the dissolving process, the contents were shaken on a wrist shaker for 12 hours. Raven carbon black 5250-B, 12.0 grams, was added to the solution, and the mixture was homogenized using a Brinkmann PT 45/80 homogenizer with a PT 20 generator for a period of 4 minutes at 9,000 rpm. The mixture was cooled in a water bath while being homogenized. Furthermore, the homogenizing time was not continuous, the homogenizer was run in period of 1 minute with 1 minute of resting time. TDI-80, 10.0 grams, Desmodur RF, 25 milliliters, and dichloromethane, 20 milliliters, were added to the previous mixture and homogenized with a PT 45/80 homogenizer and a PT-20 generator for 1 minute at 9000 rpm (cooled). The mixture was added to 0.75 percent poly(vinyl alcohol), 500 milliliters, and 2-decanol, 0.5 milliliter, and dispersed for 20 seconds at 7,500 rpm using a PT 45/80 homogenizer and a PT 35/4 probe generator. The reaction mixture was transferred to a 2 liter beaker equipped with a mechanical stirrer and an oil bath was placed under it. The mixture was stirred and heated at 50° C. for three hours, during this time hydrolysis of the isocyanate groups and an interfacial polymerization reaction took place to form a polyurea shell. The mixture continued to stir at 69° C. for the next half day. This removed some of the cyclohexane and dichloromethane from the mixture and allowed further interfacial polymerization. A model study of the hydrolysis phenomena, which results in the disappearance of the isocyanate groups was done at three different temperatures, 50° C., 60° C. and 70° C., under conditions which approximate those under which the toner particles are prepared. The percent NCO content was monitored by a titration method. Graphs of percent NCO (for toluene diisocyanate) reacted versus time (seconds) were plotted to give linear relationships. Pseudo zero rate constants (k) were calculated for each temperature. These were $4.2\times10-3$, $6.8\times10-3$ and $9.6\times10-3$ percent per second at 50, 60, 70° C., respectively. The hydrolysis was expected to be a first order reaction with respect to the concentration of isocyanate. In contrast, since the changes in total concentration of isocyanates were monitored, and not the changes in total concentration of isocyanates in the water and/or the organic phase, it is possible that the reaction appeared to be of zero order as in this case. The rate constants were also used to calculate the activation energy (Ea) for the reaction using an Arrhenius type plot. Ea was found to be 39.7 kilojoules. Zero order rate constants are usually expressed in units of moles per liter per second (moles $L^{-1}S^{-1}$). Because of variations in solution volumes, especially at 70° C., no attempts were made to calculate the exact concentration of isocyanate groups in moles/liter of organic phase and the calculated percent NCO reacted values were used to determine the reported empirical zero order rate constants above. Knowledge of the rate constants and activation energy allowed the prediction of the consumption rate of isocyanate groups via hydrolysis at any chosen temperature. The toner was washed three times with water, each time being settled using an IEC-B20A centrifuge at 8,000 rpm and for a period of 12 minutes. A 212 microns screen filter was used to remove any aggregates. The toner was spray dried with a Buchi 190 spray dryer with an inlet temperature of 120° C. and an outlet temperature of 95° C. The average particle size of this toner was 13.8 microns and its geometric standard deviation (GSD) of 1.30 as determined with a Coulter counter. This sample contains 2.6 percent Kraton DX 1115. The fix level for the toner prepared in accordance with this Example was 0.40 as measured by recording the optical density prior to, and subsequent to the known Taber Abrasion test at 100 pli pressure.

EXAMPLE IV

A carbon black encapsulated toner was prepared by repeating the procedure of Example III with the exceptions that 1) 0.9 percent Kraton was used instead of 2.6 percent of Kraton, and 2) the oil phase mixture was added to 0.75 percent poly(vinyl alcohol), 500 milliliters, and 2-decanol, 0.5 milliliters, and dispersed for 20 seconds at 6,500 rpm instead of 7,500 rpm using a Brinkmann PT 45/80 homogenizer and a PT 35/4 probe generator. The average particle size of the resulting toner was 15.2 microns and its geometric standard deviation (GSD) of 1.47 as determined with a Coulter counter.

EXAMPLE V

A carbon black encapsulated toner was prepared by repeating the procedure of Example III with the exception that the oil phase mixture was added to 0.75 percent poly(vinyl alcohol), 500 milliliters, and 2-decanol, 0.5 milliliters, and dispersed for 20 seconds at 6,500 rpm instead of 7,500 rpm using a Brinkmann PT 45/80 homogenizer and a PT 35/4 probe generator. The average particle size of this toner was 18.4 microns and its geometric standard deviation was 1.40 as determined with a Coulter counter.

EXAMPLE VI

A carbon black encapsulated toner was prepared by repeating the procedure of Example IV with the exception that 1.7 percent instead of 0.9 percent Kraton DX-1115 was used as part of the core component, and the oil phase mixture was added to 0.75 percent poly(vinyl alcohol), 500 milliliters, and 2-decanol, 0.5 milliliters, and dispersed for 15 seconds instead of 20 seconds at 6,500 rpm using a Brinkmann PT 45/80 homogenizer and a PT 35/4 probe generator. The average particle size of this toner was 17.0 microns and its geometric standard deviation (GSD) of 1.36 as determined with a Coulter counter. This toner was part of the series of toners of variable compression modulus and fix level as the proportion of Kraton DX-1115 was varied from 0 to 2.6 percent. The fix level for the toner prepared in accordance with this Example was 0.43 as measured by recording the optical density prior to, and subsequent to the known Taber Abrasion test at 100 pli pressure.

EXAMPLE VII

A carbon black encapsulated toner was prepared by repeating the procedure of Example IV with the exception that no Kraton DX-1115 was used as core component. The average particle size of the final toner was 15.6 microns and its geometric standard deviation of 1.41 as determined with a Coulter counter. The fix level for the toner prepared in accordance with this Example was 0.54 as measured by recording the optical density prior to, and subsequent to the known Taber Abrasion test at 100 pli pressure.

EXAMPLE VIII

A carbon black encapsulated toner was prepared by repeating the procedure of Example I with the exception that the organic phase was added to 0.75 percent poly(vinyl alcohol), 500 milliliters, and 2-decanol, 0.5 milliliters. This was dispersed using a Brinkmann PT 45/80 homogenizer and a PT 35/4 generator for 10 seconds instead of 15 seconds at 6,500 rpm. The average particle size of the toner product was 16 microns and the GSD was 1.50 as determined with a Coulter counter. Powder cloud images prepared from this toner in a manner identical to the one described in Example II, were fixed using a Hitachi three roll fuser set at 125 pli yielding excellent fix, that is the ratio of optical density before and after a Taber Abrasion test was about 0.5 based on a standard optical density of 1.0. In addition, the images exhibit similar crease and smear resistance as the images of Example I.

EXAMPLE IX

A carbon black colored encapsulated toner was prepared as follows: Vistanex LMMH, 22.0 grams, was dissolved in cyclohexane, 120 grams. To help speed up the dissolving process, the contents were shaken on a wrist shaker for 12 hours. Raven carbon black 5250-B, 12.0 grams, was added to the solution, and the mixture was homogenized using a Brinkmann PT 45/80 homogenizer with a PT 20 generator for a period of 4 minutes at 9,000 rpm. The mixture was cooled in a water bath while being homogenized. Furthermore, the homogenizing time was not continuous; the homogenizer was run in periods of 2 minutes with 1 minute of resting time. TDI-80, 15.8 grams, Desmodur RF, 40 milliliters, and dichloromethane, 20 milliliters, were added to the previous mixture and homogenized with a PT 45/80 homogenizer and a PT-20 generator for 1 minute at 9,000 rpm (cooled). The mixture was added to 0.75 percent poly(vinyl alcohol), 500 milliliters, and 2-decanol, 0.5 milliliters, and dispersed for 15 seconds at 6,500 rpm using a PT 45/80 homogenizer and a PT 35/4 probe generator. The reaction mixture was transferred to a 2 liter beaker equipped with a mechanical stirrer and an oil bath was placed under it. The mixture was stirred and heated at 47.5° C. for three hours, during this time an interfacial polymerization reaction took place to form a polyurea shell. The mixture continued to stir at 65° C. for the next half day. This removed some of the cyclohexane and dichloromethane from the mixture and allowed further interfacial polymerization. The toner was washed three times with water, each time being settled using an IEC-B20A centrifuge at 8,000 rpm and for a period of 12 minutes. A 212 microns screen filter was used to remove any aggregates. The toner was spray dried with a Büchi 190 spray dryer at an inlet temperature of 124° C. and an outlet temperature of 94° C. The average particle size of this toner was 15.6 microns, and its geometric standard deviation (GSD) of 1.41 as measured with a Coulter counter. After addition of Aerosil R972, Degussa Canada Ltd., this toner was imaged on a flat plate fixture system using a selenium photoreceptor. After fusing with a Hitachi three-roll fuser set at 2,000 psi, the images exhibited strong crease and smear resistance similar to the images of Examples I and II.

Other modifications of the present invention may occur to those skilled in the art based upon a reading of the present disclosure, and these modifications are intended to be included within the scope of the present invention.

What is claimed is:

1. A process for the preparation of cold pressure fixable toner compositions which comprises (1) admixing a core component comprised of pigment particles, a water insoluble organic solvent and elastomer materials with a shell monomer dissolved therein; (2) dispersing the resulting mixture in a water phase containing a stabilizing material; (3) hydrolyzing by heating the resulting mixture; (4) subsequently affecting an interfacial polymerization of the aforementioned mixture; and (5) thereafter optionally washing the resulting toner composition.

2. A process in accordance with claim 1 wherein heating for the hydrolysis is accomplished at a temperature of from about 35 to about 70 degrees Centigrade.

3. A process in accordance with claim 1 wherein the interfacial polymerization is accomplished by heating.

4. A process in accordance with claim 3 wherein the heating temperature is from about 70 to about 90 degrees Centigrade.

5. A process in accordance with claim 1 wherein washing is accomplished for removal of the stabilizer.

6. A process in accordance with claim 1 wherein the resulting toner composition is washed.

7. A process in accordance with claim 1 wherein the pigment particles are selected from the group consisting of carbon black and magnetites.

8. A process in accordance with claim 1 wherein the pigment particles are comprised of a mixture of carbon black and magnetite.

9. A process in accordance with claim 1 wherein the shell monomer is a difunctional, trifunctional or oligomeric aromatic isocyanate.

10. A process in accordance with claim 1 wherein the pigment particles are dispersed by a ball milling process.

11. A process in accordance with claim 1 wherein the pigment particles are dispersed in the core materials by a high shear mixing method.

12. A process in accordance with claim 1 wherein there is further included in the reaction components a reinforcing agent present in the core, thereby enabling minimization of smear and the optimization of the fixing properties of the images generated.

13. A process in accordance with claim 7 wherein the magnetite is a mixture of iron oxides.

14. A process in accordance with claim 9 wherein the oligomeric materials are formed insitu within the core materials.

15. A process in accordance with claim 1 wherein the elastomeric polymer is selected from the group consisting of polyisobutylene, polybutadiene, polybutenes, polyisoprenes, polysiloxanes, and copolymers of the aforementioned compositions.

16. A process in accordance with claim 15 in wherein the copolymer is poly(styrene-butadiene).

17. An imaging process which comprises the formation of an electrostatic latent image on an imaging surface, followed by developing this image with the toner composition obtained from the process of claim 1, thereafter transferring the image to a suitable substrate, and affixing the image thereon.

18. An imaging process in accordance with claim 17 wherein the toner selected contains therein magnetite.

19. An imaging process in accordance with claim 17 wherein toner selected contains wherein carbon black.

20. An imaging process in accordance with claim 17 wherein fixing is accomplished by pressure rollers maintained at a pressure of from about 80 to about 200 pounds per linear inch.

21. A process in accordance with claim 1 wherein the water insoluble organic solvent is a hydrocarbon or mixtures thereof with a boiling point above room temperature and below about 80 degrees Centigrade.

22. A process in accordance with claim 21 wherein the solvent is selected from the group consisting of cyclohexane, dichloromethane, and 1,1,1 trichloroethane.

23. A process in accordance with claim 1 wherein the stabilizing materials are selected from the group consisting of poly(vinyl alcohols), hydroxypropylcellulose, poly(ethylene oxide-co-propylene oxide) and hydroxyethyl cellulose.

24. A process in accordance with claim 1 wherein there are added to the reaction mixture additive particles.

25. A process in accordance with claim 24 wherein the additive particles are comprised of colloidal silicas.

26. A process for the preparation of cold pressure fixable toner compositions which comprises (1) dispersing carbon black in an amount of from about 5 percent to about 30 percent by weight in an organic solution comprised of a mixture of cyclohexane and dichloromethane, adding an elastomer of polyisobutylene thereto in an amount of from about 30 to about 50 percent by weight of the final toner, and subsequently dispersing therein magnetite in an amount of from 1 to about 20 percent by weight; (2) thereafter adding shell monomers in an amount of from about 10 to about 45 percent by weight, and tris(p-iscyanato-phenyl)thiophosphate; (3) dispersing the resulting mixture in water, in an amount of from about 5 to about 45 percent by volume containing from about 0.2 to about 2 percent by weight of a surfactant stabilizer; (4) subsequently heating the reaction mixture at a sufficient temperature of from about 35 to about 70 degrees Centigrade to permit hydrolysis; and thereafter heating the resulting mixture at a temperature of from about 70 to about 90 degrees Centigrade, enabling further hydrolysis and an interfacial polymerization reaction thereby allowing the formation of a hard shell; (5) subsequently washing the resulting toner composition for a sufficient period of time that will enable substantially no residual surfactant to remain in the water; and (6) thereafter spray drying the washed toner composition product thereby yielding a free flowing toner powder.

27. A process in accordance with claim 26 wherein the shell monomer is toluene diisocyanate.

28. A process in accordance with claim 26 wherein there is added to the shell monomer tris(p-isocyanato-phenyl)thiophosphate in an amount of from about 0.5 percent to about 10 percent by weight.

29. A process in accordance with claim 21 wherein there are added to the reaction mixture additive particles.

30. An imaging process which comprises the formation of an electrostatic latent image on an imaging surface, followed by developing this image with the toner composition obtained from the process of claim 26, thereafter transferring the image to a suitable substrate, and affixing the image thereon.

* * * * *